US005154011A

United States Patent [19]

Holzl et al.

[11] Patent Number: 5,154,011

[45] Date of Patent: Oct. 13, 1992

[54] CROSS COUNTRY SKI BOOT WITH A COVERING FLAP

[75] Inventors: Klaus Holzl, Vienna; Robert Stanzl, Enzersdorf/Fischa; Otakar Baburek, Vienna, all of Austria

[73] Assignee: TMC Corporation, Baar/Zug, Switzerland

[21] Appl. No.: 369,707

[22] PCT Filed: Oct. 31, 1988

[86] PCT No.: PCT/EP88/00987

§ 371 Date: Jun. 15, 1990

§ 102(e) Date: Jun. 15, 1990

[87] PCT Pub. No.: WO89/04126

PCT Pub. Date: May 18, 1989

[30] Foreign Application Priority Data

Nov. 10, 1987 [AT] Austria ..... 2964/87

[51] Int. Cl.[5] ..... A43B 5/04

[52] U.S. Cl. ..... 36/117; 36/119; 36/99; 36/54

[58] Field of Search ..... 36/117, 118, 119, 120, 36/121, 99, 136, 133, 96, 54

[56] References Cited

U.S. PATENT DOCUMENTS

| | | | |
|---|---|---|---|
| D. 280,567 | 9/1985 | Ji | 36/101 |
| 968,571 | 8/1810 | Kruckewitt | 36/54 |
| 2,109,751 | 3/1938 | Matthias et al. | 36/8.5 |
| 2,591,211 | 4/1952 | Spencer | 36/2.5 |
| 3,008,250 | 11/1961 | Herunter | 36/2.5 |
| 3,703,775 | 11/1972 | Gatti | 36/50 |
| 4,065,861 | 1/1978 | Pelfry | 36/133 |
| 4,377,913 | 3/1983 | Stone | 36/99 |
| 4,534,123 | 8/1985 | Solomon et al. | 36/99 |
| 4,724,623 | 2/1988 | Silverman | 36/112 |

FOREIGN PATENT DOCUMENTS

| | | | |
|---|---|---|---|
| 3151587 | 7/1982 | Fed. Rep. of Germany . | |
| 2499375 | 8/1982 | France | 36/54 |
| 2541566 | 8/1984 | France | 36/54 |
| 395100 | 7/1933 | United Kingdom | 36/54 |

*Primary Examiner*—Paul T. Sewell
*Assistant Examiner*—Thomas P. Hilliard
*Attorney, Agent, or Firm*—Finnegan, Henderson, Farabow, Garrett & Dunner

[57] ABSTRACT

The invention relates to a sports boot, in particular a cross-country ski boot. The cross-country ski boot is provided with a high outer upper and a low inner upper. The inner upper has a tie fastening for holding the foot. The outer upper is closed by a covering flap. According to the invention, the tie fastening of the inner upper also grips the outer upper, preferably in its ankle bending zone.

7 Claims, 3 Drawing Sheets

CROSS COUNTRY SKI BOOT WITH A COVERING FLAP

BACKGROUND OF THE INVENTION

1. Field of the Invention

The invention relates to a sports boot, in particular a cross-country ski boot, which has a low inner upper which may be laced and a high outer upper with a quick closure fastener.

2. Description of the Related Art

Such a sports boot is disclosed, for example, in German Offenlegungsschrift 3,151,587. This known sports boot has a higher outer upper and a lower inner upper, the inner upper being closable by means of a tie fastening and thus holding the foot during use of this sports boot. The outer upper in this known cross-country ski boot is closed by a covering flap with a quick-closure device (adhesive closure). Such adhesive closures are known by the trade name VELCRO TM.

This known cross-country ski boot has the disadvantage that the outer upper is closed and held only by the covering flap. In the course of cross-country skiing the ankle joint is greatly flexed with each step. Great stresses consequently occur in the cross-country ski boot in the bending zone of the ankle joint, and creases are produced in the bending zone of the boot during flexing of the foot. This causes the covering flap, which is in fact held on the upper only by an adhesive closure, to become detached during lengthy skiing periods, and it has to be fastened again repeatedly by the skier. This arises all the more so if, as is usual in practice, the covering flap is sewn only at its front end to the outer upper and held by a VELCRO TM strip at both sides of the access opening, in order to make it easier to put on the ski boot.

The known cross-country ski boot also has the disadvantage that the tie fastening of the inner upper is difficult to reach, and the user is obstructed by the outer upper when tying a knot or bow. Moreover, the bow or knot is then on the inside of the outer upper, which can lead to unpleasant pressure sensations, in particular during lengthy use.

SUMMARY OF THE INVENTION

The object of the invention is to avoid the disadvantages of the known cross-country ski boot and to produce a cross-country ski boot in which the covering flap performs no holding function, but only a covering function for the outer upper, as a protection against cold and snow. In addition, the cross-country ski boot is to be simple and easy to put on and close, and will be simple and inexpensive to manufacture.

This object is achieved according to the invention by providing tie fastening of the inner upper which also holds the outer upper, preferably in its ankle joint flexing zone thus, tensile forces in this heavily stressed region of the outer upper are absorbed by the tie fastening. The covering flap consequently does not have to absorb any forces, and can therefore be of a simple and inexpensive design, while still ensuring a secure closure even with lengthy use. The cross-country ski boot according to the invention also has the advantage that through the arrangement of the tie fastening the closure of the boot is facilitated also at the outer upper, and the bow or knot in the end lies outside the outer upper.

It is also known in a cross-country ski boot available on the market to provide the covering flap with an elongated eyelet, while a fastening strip sewn to the upper of the boot in its upper region is fed through the eyelet by its free end, and the free end is then fixed on the outer upper. Although this ensures a good closure of the cross-country ski boot also in the upper edge area of the outer upper and a secure hold for the covering flap in this region, the known solution is labour-intensive and thus expensive.

The invention ensures a good closure of the topmost outer upper area and at the same time ensures that the covering flap does not have to absorb any holding forces in this area either. This measure can advantageously be used in a sports boot, either alone or in conjunction with other aspects of the invention.

Further, the invention provides a particularly simple and inexpensive solution to overcoming the previously described deficiencies of the related art.

The tie fastening is even further improved by the measure claimed in claim 3.

The invention ensures a great fatigue strength of the tie fastening.

If flexible bootlaces are provided for closing the outer upper, the lacing-up will be even further facilitated, since friction of the bootlace in the narrow lacehole is avoided. This advantage is also produced if two or more pair of supple lace loops are used VELCRO TM may be used along the entire length of the covering flap to better secure the cover in place being better held here.

The measure contained in claim 8 is advantageous for VELCRO TM may be used along the entire length of the covering flap to better secure the cover in place.

BRIEF DESCRIPTION OF THE DRAWINGS

Further advantages and features of the invention are now explained in greater detail with reference to the drawings, which illustrates four exemplary embodiments.

DETAILED DESCRIPTION OF THE PREFERRED EMBODIMENT

In the description of the figures below the same parts of different embodiments are provided with the same reference numbers.

Figure 1:
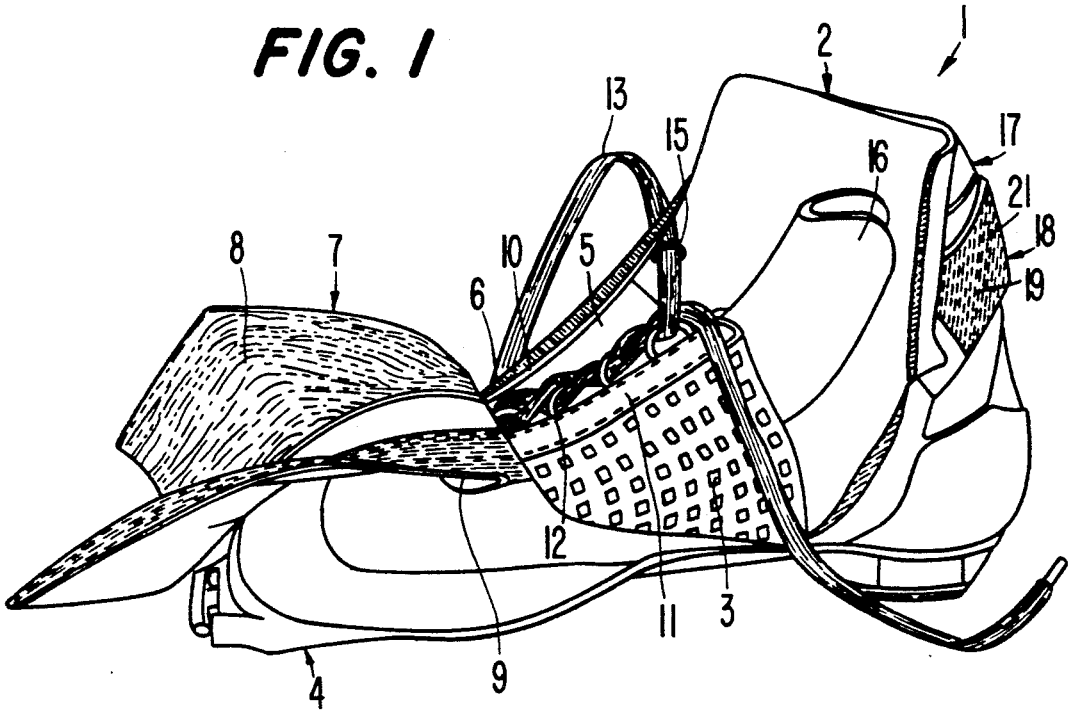
FIG. 1 shows a first embodiment of the cross-country ski boot according to the invention in perspective, partially cut away.
Figure 2:
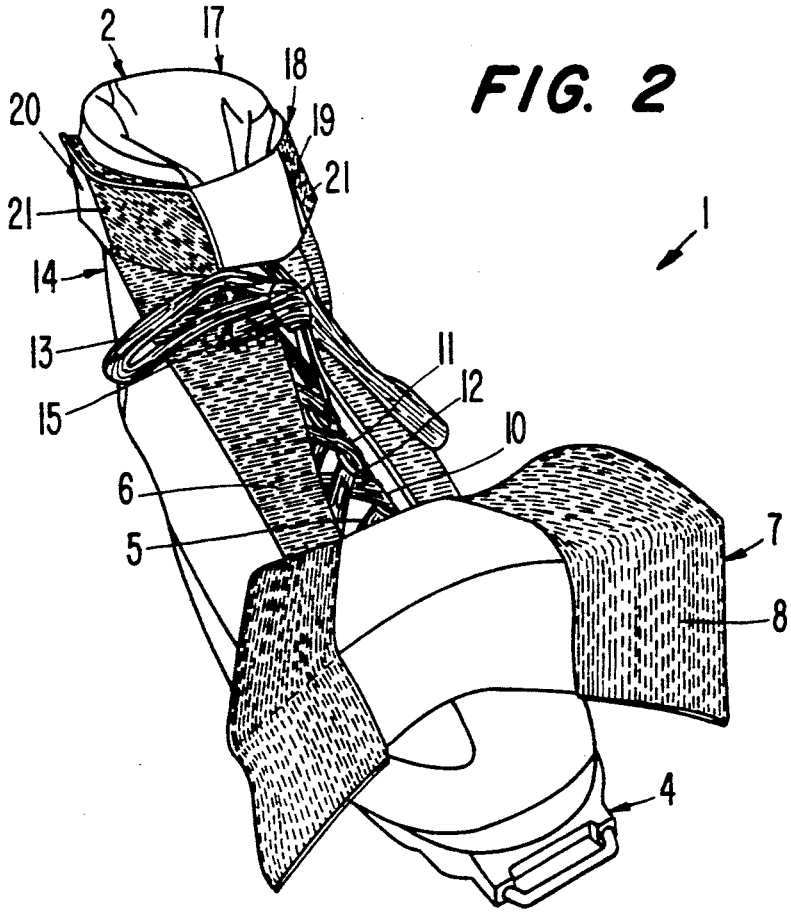
FIG. 2 shows the cross-country ski boot of FIG. 1 partially closed.
Figure 3:
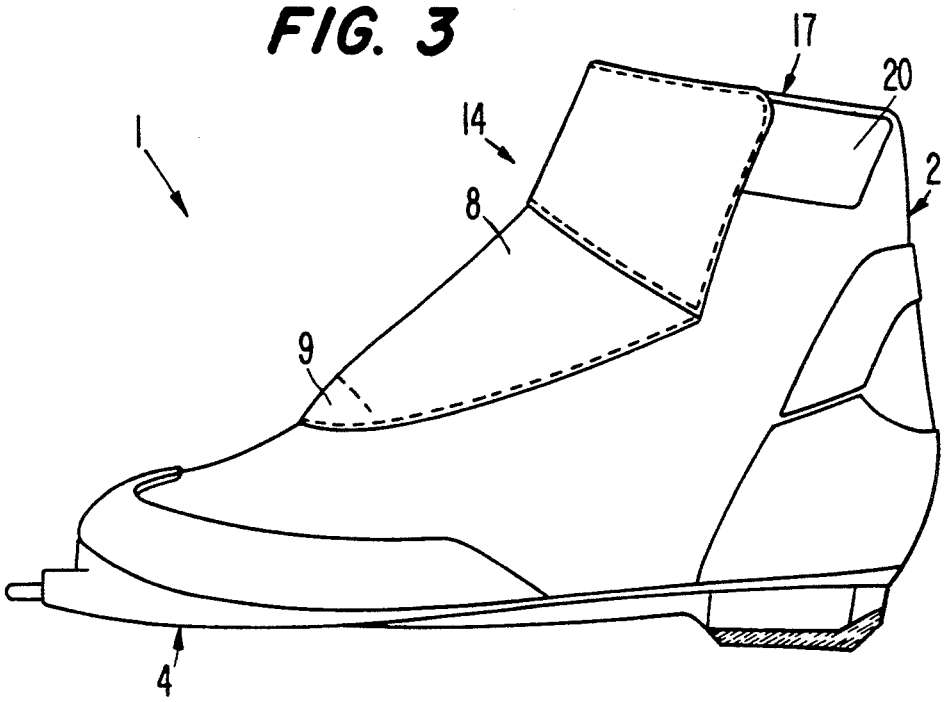
FIG. 3 shows the cross-country ski boot of FIG. 1 when closed, in a side view.

FIG. 1 shows a cross-country ski boot 1, essentially comprising an outer upper 2, an inner upper 3, and a sole 4. The outer upper 2 is approximately ankle-high and can be provided with reinforcement parts, which however do not constitute the object of the invention and will not therefore be described in further detail. As can be seen in FIG. 2 in particular, the outer upper 2 has a slit-shaped access opening 5 on the outer upper 2. Closure areas 6 with-an adhesive closure system, for example of the VELCRO TM type, are provided near the access opening 5 on the outer. The counterpart to this adhesive closure system is on the inner side areas 8 of a covering flap 7. The covering flap 7 in this exemplary embodiment is fastened to the outer upper 2 only by its front end area 9. This makes the slit-type access opening 5 easily accessible and the cross-country ski boot 1 easy and convenient to put on.

The sole 4 is designed in a known manner and is not therefore described in greater detail here.

The inner upper 3 extends essentially in the region of the front of the foot and of the instep, as can be seen in FIG. 1. It could, however, be made longer, for example in the form of a complete, low inner boot. Lace edges 11 with lace loops 12 for a bootlace 13 are provided on the inner upper 3 for a tie fastening 10. The inner upper 3 is preferably made of a supple, but firm material, in order to ensure an optimum hold of the foot in the sports boot. A padded tongue 16 is provided inside the inner upper 3. The exact design of lining, welt, insole etc. is known per se and does not constitute the object of the invention. A description of these details is therefore omitted.

As can be seen in FIGS. 1 and 2, a lacehole 15 is provided in the outer upper 2 in its ankle joint bending zone 14 on either side of the access opening 5. The bootlace 13 of the tie fastening 10 of the inner upper 3 is passed through these two laceholes 15. As can be seen in FIG. 2, it is thereby possible to hold the outer upper 2 together in the ankle joint bending zone 14 by the bootlace 13. It can also be seen in FIG. 2 that the bootlace 13 is tied outside the outer upper 2, which means that pressure points can be avoided.

A strip-shaped holding flap 18 is fastened by its first end area 19 on a top edge area 17 of the outer upper 2, in the present exemplary embodiment being sewn on. When the shoe is closed, the strip-shaped holding flap 18 extends transversely over a partial area of the access opening 5 and is held by its second end area 20 by means of an adhesive closure of the VELCRO TM type on the outer upper 2, as a result of which the latter is held together in its closed position. Side area 21 of the strip-shaped holding flap 18 are also provided with such an adhesive closure, on which the covering flap 7 is fastened when the shoe is closed.

Figure 4:
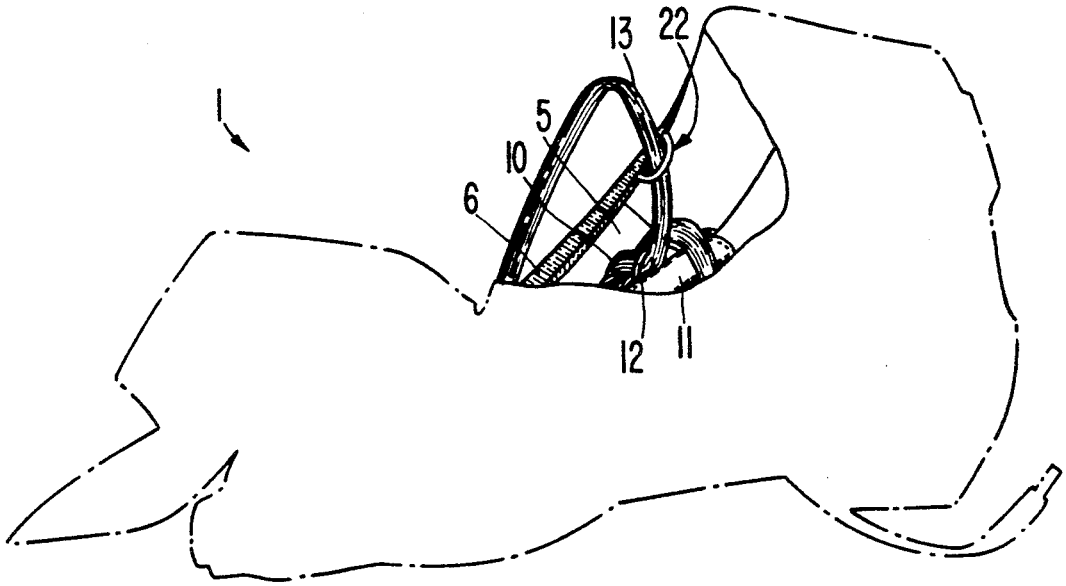
FIG. 4 depicts a variation of the lacing systems shown in FIGS. 1 and 2, in accordance with the invention.

FIG. 4 shows more of a detail of a second variant of an embodiment of the cross-country ski boot 1 according to the invention. Instead of a lacehole in the outer upper 2, a lace loop 22 is in this case fastened on each edge of the access opening 5. The bootlace 13 is passed through the lace loops 22 and, as described in the first exemplary embodiment, can be tied outside the outer upper 2. According to a variant of an embodiment which is not shown separately, the lace loops can also be provided on the outer upper some distance away from the access opening. For the rest, the cross-country ski boot is designed in exactly the same way as described for the first embodiment, and will not therefore be described again.

Figure 5:
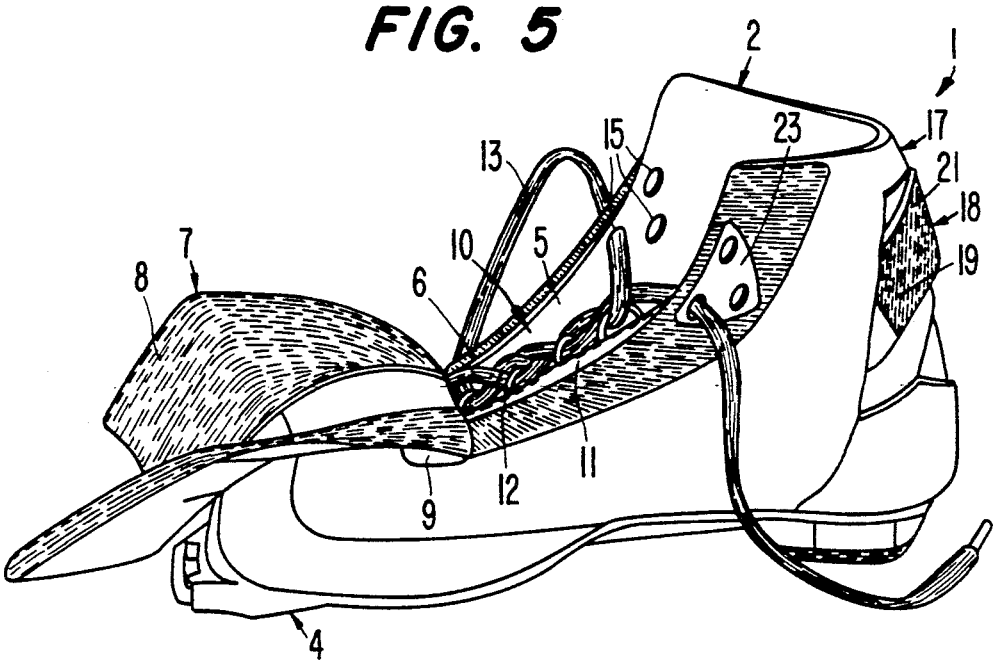
FIG. 5 shows a second an embodiment of the cross-country ski boot according to the invention.

Another variant of an embodiment of the cross-country ski boot 1 according to the invention can be seen in FIG. 5. In this case three laceholes 15, through which the bootlace 13 is passed as described above, are provided in the ankle joint bending zone 14 on either side of the access opening 5, preferably in a staggered arrangement. The region in which the laceholes 15 are disposed can in this case be provided with reinforcement parts 23, for example of leather or plastic, as shown.

Figure 6:
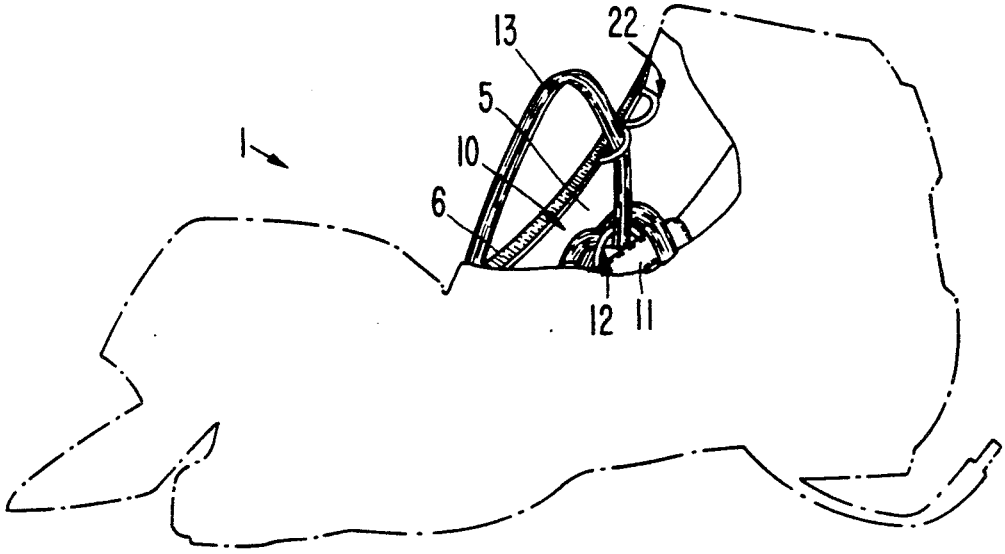
FIG. 6 shows variation of the lacing system shown in FIG. 5, in accordance with the invention.

FIG. 6 shows a variant of the embodiment shown in FIG. 4. Two lace loops 22 for the bootlace 13 are fastened here on each edge of the access opening 5.

Of course, the invention is not restricted to the exemplary embodiments shown. On the contrary, numerous modifications thereof which do not go beyond the scope of the invention are possible. It is, for example, possible to make the inner upper different from the way shown, e.g. it could be made in several parts. The covering flap could also be sewn partially at one side, instead of in the front region. Of course, the embodiment of the tie fastening and the closure according to the invention is suitable not only for cross-country ski boots, but also for all footwear for sports in which the foot is flexed frequently at the ankle joint.

We claim:

1. A sports boot, comprising:

a first upper having a first elongated opening along a central portion thereof, the first opening including lacing means disposed along edges thereof for closing the first opening and for providing a gripping force to the foot of a wearer;

enclosing means for surrounding and covering the first upper and the lacing means to protect the first upper and the lacing means from cold and moisture, the enclosing means including a second upper substantially surrounding the first upper and having a second elongated opening having an end located in an area of high flexure of a wearer's ankle, the second opening substantially overlying the first opening, the enclosing means also including a flap for covering the second opening and the lacing means, the flap having upper and lower edge regions and transverse edge regions extending between and connecting the upper and lower edge regions, the flap being permanently connected at the lower edge region thereof to the second upper;

means disposed in the second upper, proximate the end of the second opening for receiving a tie fastener to maintain the second upper in a closed position and for reducing pressure sensations of a tie fastening knot on a wearer's foot;

quick-closure means disposed along the transverse edge regions of the flap for permitting the transverse edge regions to be selectively attachable and detachable from the second upper; and an ankle area closure disposed on the second upper and having a portion that is selectively connectable to and detachable from the second upper with a quick closure adhesive, the ankle area closure also including quick closure adhesive for selective connection to and detachment from the flap.

2. The sports boot of claim 1 further including a tongue disposed on an inside of the first upper, adjacent the first opening.

3. The sports boot of claim 1 wherein the means disposed in the second upper include at least one pair of lace holes.

4. The sports boot of claim 3 further including reinforcing parts located in a region of the lace holes.

5. The sports boot according to the claim 1 wherein the means disposed in the second upper includes at least one pair of supple lace loops.

6. The sports boot of claim 4 wherein said at least one pair of supple lace loops is two or more pair of supple lace loops.

7. The sports boot of claim 1 further including a sole upon which the first and second uppers are mounted, the sole including a portion that is attachable to the binding of a snow ski.

* * * * *